US009659729B2

(12) United States Patent
Bartz et al.

(10) Patent No.: US 9,659,729 B2
(45) Date of Patent: May 23, 2017

(54) ELECTRICAL SWITCH

(71) Applicant: SIEMENS AKTIENGESELLSCHAFT, Munich (DE)

(72) Inventors: Michael Bartz, Berlin (DE); Frank Ehrlich, Hohen Neuendorf (DE); Alexander Golub, Berlin (DE); Andre Matthaei, Bernau Ot Schoenow (DE); Caroline Orth, Berlin (DE); Rico Rademacher, Ludwigsfelde (DE); Ingolf Reiher, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/033,218

(22) PCT Filed: Sep. 24, 2014

(86) PCT No.: PCT/EP2014/070311

§ 371 (c)(1),
(2) Date: Apr. 29, 2016

(87) PCT Pub. No.: WO2015/062786

PCT Pub. Date: May 7, 2015

(65) Prior Publication Data

US 2016/0254110 A1 Sep. 1, 2016

(30) Foreign Application Priority Data

Oct. 29, 2013 (DE) ..... 10 2013 221 910

(51) Int. Cl.
*H01H 33/666* (2006.01)
*H01H 33/662* (2006.01)
*H01H 1/50* (2006.01)

(52) U.S. Cl.
CPC ..... *H01H 33/66207* (2013.01); *H01H 1/50* (2013.01); *H01H 33/666* (2013.01); *H01H 2205/002* (2013.01); *H01H 2235/01* (2013.01)

(58) Field of Classification Search
CPC ..... H01H 33/666; H01H 13/705; H01H 2003/3063; H01H 2223/002; H01H 33/50;
(Continued)

(56) References Cited

U.S. PATENT DOCUMENTS 2,985,737 A 5/1961 Mikos
4,209,679 A * 6/1980 Koppl ..... H01H 33/982 218/59
(Continued)

FOREIGN PATENT DOCUMENTS

CN 2052945 U 2/1990
CN 201673818 U 12/2010
(Continued)

OTHER PUBLICATIONS

Bal Seal Engineering: "Konstruktionshandbuch—Dichtungen SE1DE; XP055157460"; found on the internet: URL:http://www.georg-rutz.ch/userfiles/media/selde_gdlg.pdf [found on: Dec. 8, 2014] chapter 6.

*Primary Examiner* — Truc Nguyen
(74) *Attorney, Agent, or Firm* — Laurence Greenberg; Werner Stemer; Ralph Locher

(57) ABSTRACT

An electrical switch includes a gas-insulated tube, a contact system in the tube having fixed and movable contacts, a contact operating element passed out of the tube and movable along an actuation direction for opening and closing the system, and a contact pressure spring movable along the direction, connected to the operating element and an external drive element and disposed in a stationary guide part. The guide part guides the operating element. If the drive element shifts along the direction toward the fixed contact, the spring, operating element and movable contact move toward the fixed contact, closing the system and compressing the spring providing contact pressure force. The spring is in a
(Continued)

housing connected to the operating element and movable relative to the guide part. A guide element is attached outside the housing, bears against the guide part, guides the housing and guides the operating element along the direction.

13 Claims, 4 Drawing Sheets

(58) Field of Classification Search
CPC .. H01H 33/53; H01H 33/6606; H01H 33/662; H01H 33/66207; H01H 3/30; H01H 3/56; H01H 71/08; H01H 71/10; H01H 9/20
See application file for complete search history.

(56) References Cited

U.S. PATENT DOCUMENTS 4,381,435 A 4/1983 Barkan
4,585,911 A 4/1986 Has et al.
5,808,258 A * 9/1998 Luzzi ..... H01H 33/66207 218/136
8,309,872 B2 * 11/2012 Peter ..... H01H 33/666 218/140
2005/0067380 A1 * 3/2005 Rhein ..... H01H 33/6662 218/118
2011/0036812 A1 2/2011 Nagatake et al.
2012/0103940 A1 * 5/2012 Ohda ..... H01H 33/166 218/50

FOREIGN PATENT DOCUMENTS

CN 102017040 A 4/2011
CN 103133732 A 6/2013
DE 3529386 A1 2/1987
DE 69307560 T2 5/1997
EP 0117004 A1 8/1984
EP 2270827 A1 1/2011
FR 2706675 A1 12/1994

* cited by examiner

ELECTRICAL SWITCH

BACKGROUND OF THE INVENTION

Field of the Invention

The invention relates to an electrical switch having a gas-insulated tube, a contact system disposed in the tube and including a fixed contact and a moving contact, a moving contact operating element mechanically and electrically connected to the moving contact, routed out of the tube through an opening in the tube, and being movable along an operating direction for opening and closing the contact system, and a contact-pressure spring to be moved along the operating direction and being connected to the moving contact operating element and to an external drive element, and being disposed in a stationary guide part of the switch guiding the moving contact operating element. In the event of the external drive element moving along the operating direction in the direction of the fixed contact, the contact-pressure spring, the moving contact operating element and the moving contact move in the direction of the fixed contact, the contact system is closed and the contact-pressure spring is compressed with the provision of a contact-pressure force.

An electrical switch of this kind is known from European laid-open specification EP 2 270 827 A1. Said switch has a gas-insulated tube and a contact system which is arranged in the tube and comprises a fixed contact and a moving contact. Also provided is a moving contact operating element which is mechanically and electrically connected to the moving contact, is routed out of the tube through an opening in said tube, and can be moved along an operating direction for the purpose of opening and closing the contact system. The switch further comprises a contact-pressure spring which can be moved along the operating direction and is connected to the moving contact operating element and also to an external drive element, and is arranged in a stationary guide part of the switch, which guide part guides the moving contact operating element. In the event of the external drive element moving along the operating direction in the direction of the fixed contact, the contact-pressure spring, the moving contact operating element and also the moving contact move in the direction of the fixed contact, the contact system is closed and the contact-pressure spring is compressed with the provision of a contact-pressure force.

The problem of ensuring that the moving contact operating element which is routed out of the tube is guided to a sufficient extent is encountered in electrical switches with large and/or long gas-insulated tubes. The object of the invention is accordingly to specify a switch in which the problem of satisfactory guiding of the moving contact operating element is achieved in a structurally simple manner and at low cost.

BRIEF SUMMARY OF THE INVENTION

According to the invention, this object is achieved by a switch having the features recited below. Advantageous refinements of the switch according to the invention are specified in the dependent claims.

Accordingly, the invention makes provision for the contact-pressure spring to be arranged in a spring housing which is rigidly connected to the moving contact operating element and can be moved relative to the stationary guide part, and for at least one guide element to be fixedly attached to the outside of the spring housing, said guide element bearing against the stationary guide part and guiding the spring housing and also guiding the moving contact operating element along the operating direction.

A significant advantage of the switch according to the invention can be seen in that the spring housing has a dual function: it firstly serves to hold the contact-pressure spring, and secondly serves to guide the moving contact operating element. Guiding of the contact operating element can be improved without a great deal of expenditure and in a structurally simple manner by the incorporation of the spring housing.

In order to guide the contact operating element in the region of the spring housing particularly effectively, it is considered to be advantageous when two guide elements—spaced apart as seen along the operating direction—are attached to the spring housing and bear against the guide part.

In respect of the design of the spring housing, it is considered to be advantageous when said spring housing has a pot-like housing part and a cover part. When the spring housing is designed in this way, it is particularly advantageous when at least one of the guide elements is attached to or integrally formed on the pot-like housing part, and/or at least one of the guide elements is attached to or integrally formed on the cover part.

The external drive element can project, for example, into the spring housing, in particular into the pot-like housing part, in order to interact with the contact-pressure spring.

In respect of guiding the contact operating element in an optimum manner, it is further considered to be advantageous when a further guide element, which guides the moving contact operating element, is arranged between the spring housing and the tube—as seen along the operating direction.

With respect to the arrangement of the further guide element, it is advantageous when a contact disk is attached to or integrally formed on the moving contact operating element between the spring housing and the tube, and the further guide element is attached radially to the outside of the contact disk.

The contact disk and the further guide element preferably fulfill a dual function, specifically a guiding function and also an electrically conductive function; accordingly, it is advantageous when the contact disk and the further guide element are electrically conductive and enable current flow from the moving contact operating element, through the contact disk and the further guide element, to the guide part—and vice versa.

With respect to the design of the guide part, it is considered to be advantageous when said guide part is hollow-cylindrical or has at least one hollow-cylindrical section.

The guide element or guide elements which is/are attached to the spring housing preferably bears/bear radially against an inner wall of the hollow-cylindrical guide part or of the hollow-cylindrical section of the guide part.

The guide element or guide elements which is/are attached to the outside of the spring housing is/are preferably formed by a guide ring. In a corresponding manner, it is also advantageous when the further guide element or the further guide elements, which is/are arranged in the region between the spring housing and the tube, is/are formed by guide rings.

In respect of also guiding the contact operating element in the region of the tube, it is considered to be advantageous when the tube has a bearing or a bearing is attached to the tube, said bearing guiding the moving contact operating element in the region of the exit point of the moving contact operating element out of the tube along the operating direction.

The gas-insulated tube may be, for example, a vacuum tube; in this case, the switch is preferably a vacuum circuit breaker.

BRIEF DESCRIPTION OF THE SEVERAL VIEWS OF THE DRAWING

The invention will be explained in greater detail below with reference to exemplary embodiments; in this respect.

DESCRIPTION OF THE INVENTION

In the figures, the same reference symbols are always used for identical or comparable components for reasons of clarity.

Figure 1:
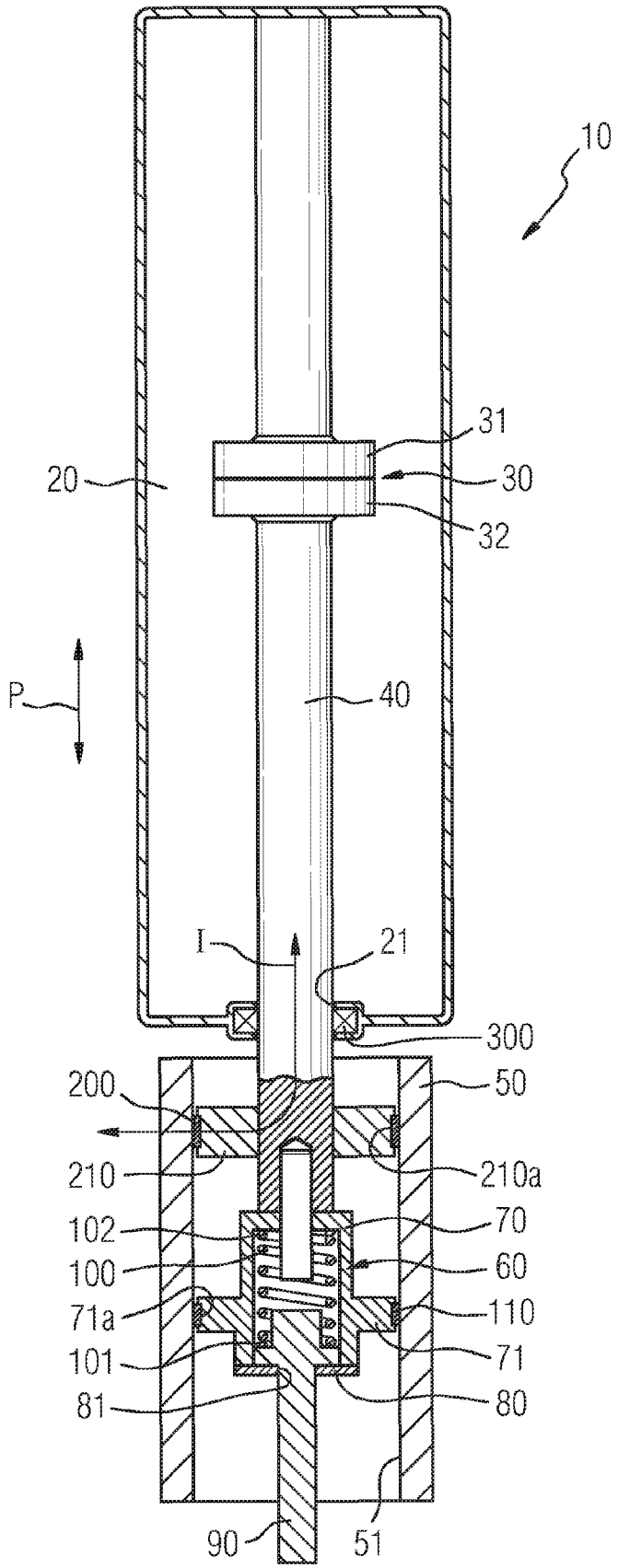
FIG. 1 shows, by way of example, an exemplary embodiment of a switch according to the invention, in which a guide element for guiding a moving contact operating element is attached to a spring housing.

FIG. 1 shows an electrical switch 10 which may be, for example, a vacuum circuit breaker. The switch 10 has a gas-insulated tube 20, for example in the form of a vacuum tube, in which a contact system 30 comprising a fixed or rather stationary contact 31 and also a contact 32 which can move in relation to the fixed contact 31 is arranged.

A moving contact operating element 40 is provided in order to move the moving contact 32 along an operating direction P relative to the fixed contact 31, said moving contact operating element being connected to the moving contact 32 and allowing the moving contact 32 to move along the operating direction P. In the exemplary embodiment, the moving contact 32 and the moving contact operating element 40 are formed by separate elements which are connected to one another; as an alternative, the moving contact 32 and the contact operating element 40 can also be of integral design, or rather can be formed by a single component.

The moving contact operating element 40 extends through an opening 21 in the gas-insulated tube 20, out of said opening, into a stationary guide part 50. In the exemplary embodiment according to FIG. 1, the stationary guide part 50 is formed by a hollow-cylindrical body, or rather by a tube.

As shown in FIG. 1, the moving contact operating element 40 is connected to a spring housing 60 which can be of integral or multipartite design. In the exemplary embodiment according to FIG. 1, the spring housing 60 is of two-part design and is formed by a pot-like housing part 70 and also a cover part 80 which is located beneath the pot-like housing part 70 in the illustration according to FIG. 1. The cover part 80 is provided with an opening 81 through which an external drive element 90 projects into the interior of the spring housing 60.

The external drive element 90 is connected to a spring end 101 of a contact-pressure spring 100 which is located within the spring housing 60 and of which that spring end 102 which is averted from the external drive element 90 is supported on the pot base of the pot-like housing part 70.

The external drive element 90 can be used to move the moving contact operating element 40, and also the contact 32 which moves in association with it, along the operating direction P, so that the contact system 30 can be opened or closed. In this case, the contact pressure spring 100 ensures that, when the contact system 30 is closed, there is a sufficient contact-pressure force between the fixed contact 31 and the moving contact 32; furthermore, the contact-pressure spring 100 ensures that, when the contact system 30 is opened, a so-called separating shock is generated, this being used to release or break any possible welding of the contact system 30.

Moreover, a switching rod, not illustrated in the figures, can be connected to the external drive element 90, for example by means of a rotary joint, it being possible for the drive element 90 to be moved by said switching rod in order to switch over the switch 10.

As shown in FIG. 1, a flange section 71 is integrally formed on the pot-like housing part 70, said flange section extending radially outward in the direction of the inner wall 51 of the guide part 50. A guide element 110 in the form of a guide ring is provided between the flange section 71 and the inner wall 51 of the guide part 50; the guide element 110 is situated in a radially outer ring-like guide groove, or rather annular groove 71*a* of the flange section 71 and, in the case of a movement of the spring housing 60 along the operating direction P relative to the stationary guide part 50, will be moved with said flange section. The function of the guide element 110 is to ensure that the moving contact operating element 40 is guided and therefore that the moving contact 32 is guided during the movement along the operating direction P.

In order to yet further improve guiding of the moving contact operating element 40, a further guide element 200 is provided in the exemplary embodiment according to FIG. 1, it being possible for said guide element to likewise be a guide ring. The further guide element 200 is situated radially on the outside in an annular groove 210*a* of the contact disk 210 which is either integrally formed on the moving contact operating element 40 or is attached radially to the outside of the moving contact operating element 40. Therefore, the further guide element 200 ensures, together with the contact disk 210, further guiding of the contact operating element 40 during the movement along the operating direction P within the guide part 50.

In addition to the described guiding function, the further guide element 200 and the contact disk 210 can have an electrical function if they—as is considered to be advantageous—are designed electrically with a low impedance and/or so as to conduct current. If, specifically, the further guide element 200 and the contact disk 210 are electrically conductive, a current flow I can take place along the double-headed arrow, which is identified by reference symbol I, between the guide part 50 and the contact operating element 40, as a result of which a current flow through the spring housing 60 is advantageously avoided. In other words, the current flowing through the contact system 30 will therefore pass by the spring housing 60 and the contact-pressure spring 100 located in said spring housing via the further guide element 200 and the contact disk 210.

In the exemplary embodiment according to FIG. 1, guiding of the contact operating element 40 within the guide part 50 is ensured by the guide element 110 and the further guide element 200. In order to furthermore also ensure particularly good guiding in the region of the opening 21 in the tube 20, a bearing 300 is additionally provided in the region of the opening 21 in the exemplary embodiment according to FIG. 1. In other words, three guide elements are therefore provided in the exemplary embodiment according to FIG. 1, specifically the guide element 110 in the region of the spring housing 60, the further guide element 200 in the region between the spring housing 60 and the opening 21, and also the bearing 300 which is attached to the tube 20, or rather is formed in said tube, in the region of the opening 21.

Figure 2:
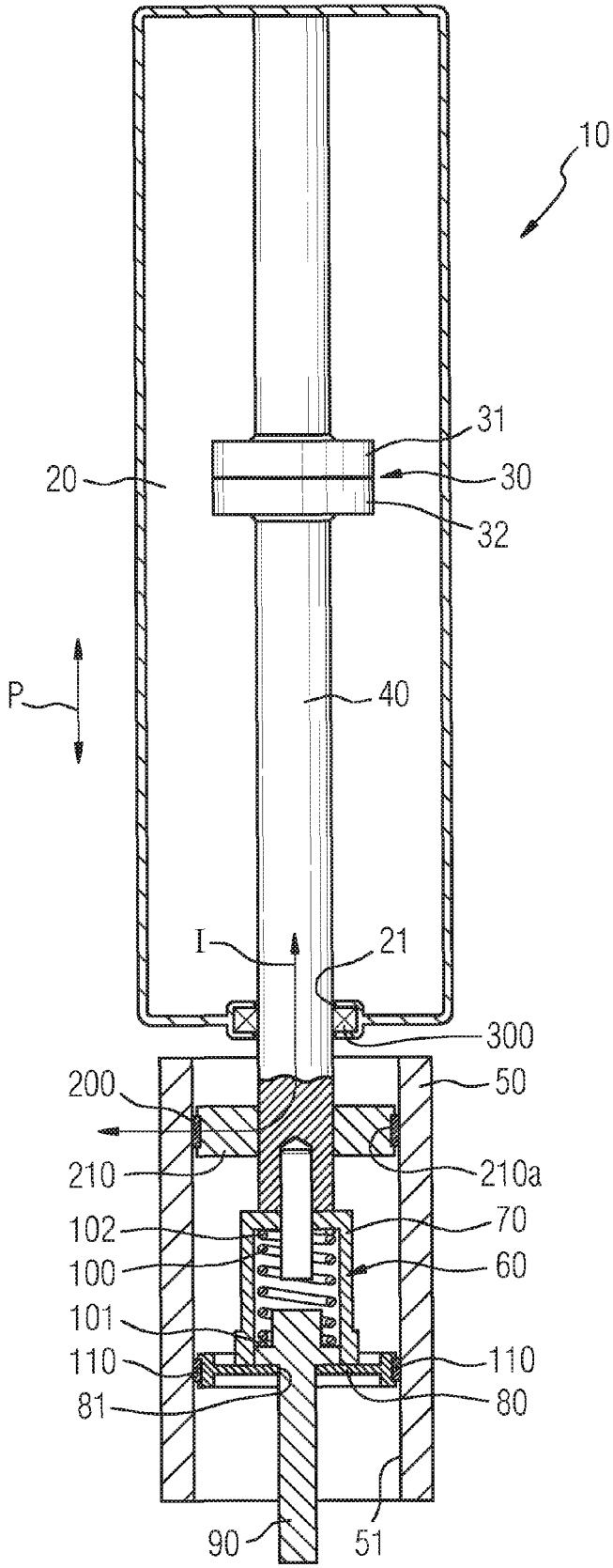
FIG. 2 shows, by way of example, a further exemplary embodiment of a switch according to the invention, in which a guide element is attached to a spring housing.

FIG. 2 shows a further exemplary embodiment of a switch 10, in which a guide element 110 is attached to a two-part spring housing 60. In contrast to the exemplary embodiment according to FIG. 1, in the exemplary embodiment according to FIG. 2, the guide element 110 is not attached to the pot-like housing part 70, or rather to the flange section 71 of the pot-like housing 70, but rather in the region of the cover part 80.

In order to allow or to simplify attachment of the guide element 110 to the cover part 80, said guide element is designed to be larger than the cover part 80 in the radial direction or perpendicular to the operating direction P according to FIG. 1. The design of the cover part 80 shown in FIG. 2 allows radially outer positioning of the guide element 110 between the cover part 80, or rather the spring housing 60, and the guide part 50, so that the guide element 110 can ensure guiding of the contact operating element 40, as has already been described in connection with FIG. 1.

The switch 10 according to FIG. 2 is also equipped with a further guide element 200 in the region between the spring housing 60 and the opening 21 in the vacuum tube 20 and also with a bearing 300 in the region of the opening 21; in respect of the function of the further guide element 200 and of the bearing 300, reference may be made to the above explanations in connection with FIG. 1 in respect of guiding the contact operating element 40. The above explanations in respect of the current-carrying properties of the guide element 200 and of the contact disk 210 also correspondingly apply in the exemplary embodiment according to FIG. 2 since the guide element 200 and the contact disk 210 are also preferably electrically conductive in the exemplary embodiment according to FIG. 2.

Figure 3:
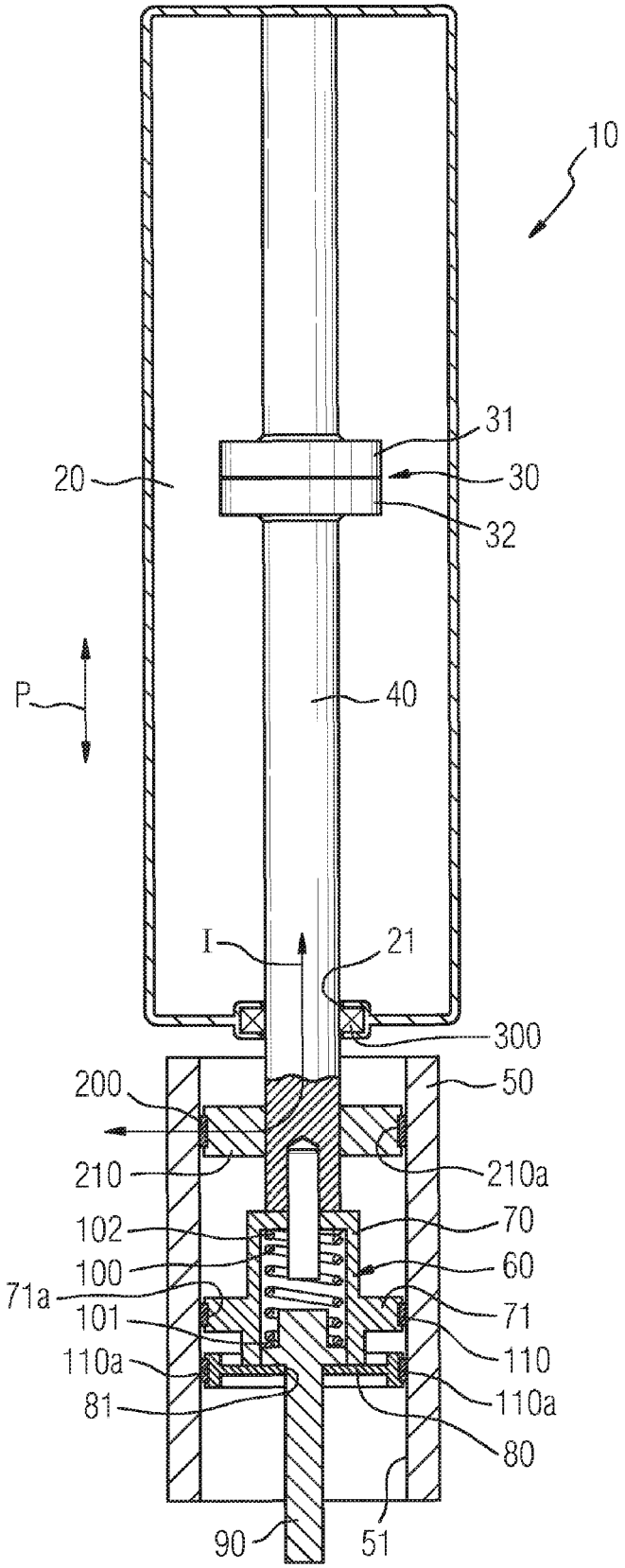
FIG. 3 shows, by way of example, an exemplary embodiment of a switch in which two guide elements are attached to the spring housing of the switch such that they are spaced apart—as seen along the operating direction of the switch—and a further guide element is attached physically between the spring housing and a tube of the switch.

FIG. 3 shows an exemplary embodiment of a switch 10, in which not only one guide element 110, but rather two guide elements 110 and 110*a* are arranged on a two-part spring housing 60. The two guide elements 110 and 110*a* are arranged spaced apart from one another as seen along the operating direction P, so that the two guide elements 110 and 110*a* alone can already guide the contact operating element 40 for a movement along the movement direction P themselves.

As shown in FIG. 3, the guide element 110 is preferably attached to a flange section 71 of the pot-like housing part 70, as has already been explained in connection with FIG. 1; and the guide element 110*a* is attached in the region of the cover part 80, as has already been explained above in connection with FIG. 2.

In the exemplary embodiment according to FIG. 3, the contact operating element 40 is guided along the operating direction P, that is to say through the two guide elements 110 and 110*a* which are attached to the spring housing 60, the further guide element 200 which is attached to the electrically conductive contact disk 210, and also the bearing 300 in the region of the opening 21 in the tube 20.

Figure 4:
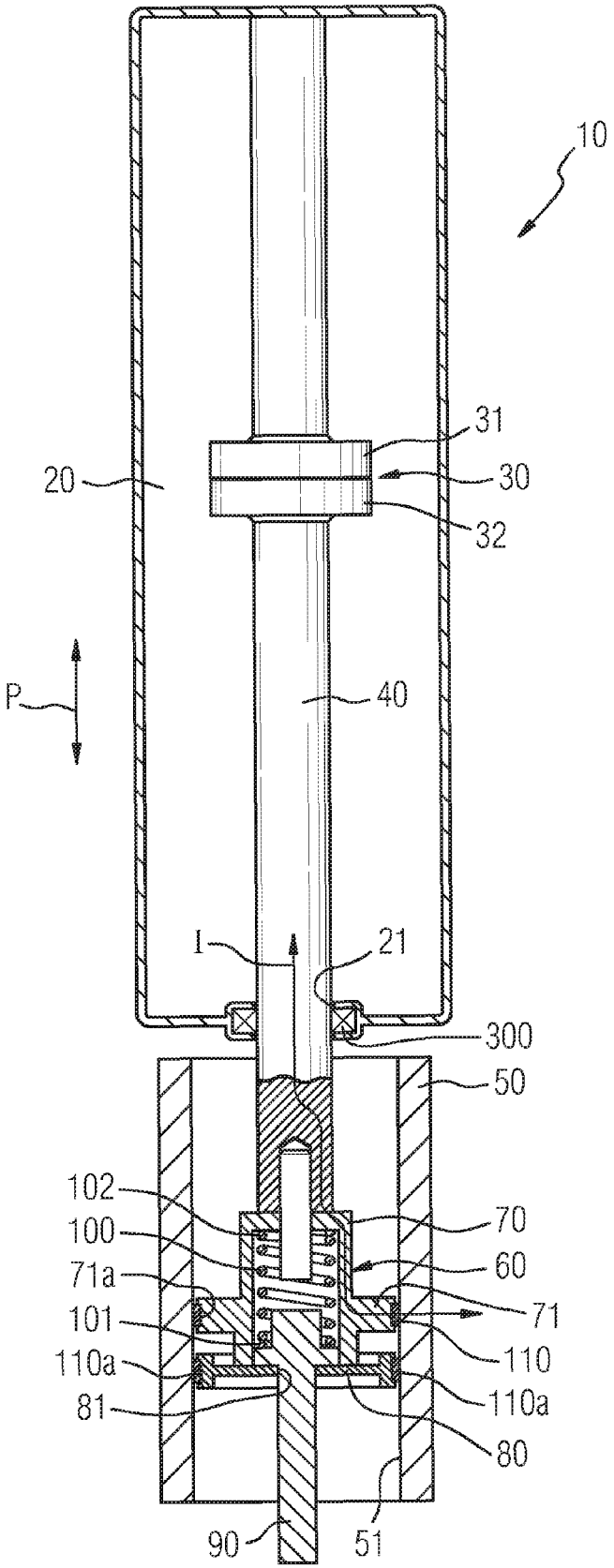
FIG. 4 shows, by way of example, an exemplary embodiment of a switch according to the invention having two guide elements in the region of the spring housing, but without a further guide element in the region between the spring housing and the tube.

FIG. 4 shows an exemplary embodiment of a switch 10, in which two guide elements 110 and 110*a* are attached to the spring housing 60, as is also the case in the exemplary embodiment according to FIG. 3. In contrast to the exemplary embodiment according to FIG. 3, the exemplary embodiment according to FIG. 4 does not have the further guide element 200 or the contact disk 210, so that guiding of the contact operating element 40 is based solely on the two guide elements 110 and 110*a* and also the bearing 300.

Since the further guide element 200, or rather the contact disk 210 (cf. FIGS. 1 to 3), is omitted, it is not possible for the current flowing through the contact system 30 to pass by the spring housing 60, but rather the current has to flow through the pot-like housing part 70, the flange section 71 and also the guide element 110, which is located on the flange section 71, to the guide part 50. In the refinement according to FIG. 4, it is therefore advantageous to design the pot-like housing part 70 and also the flange section 71 to be very solid, or rather have a very thick wall, in order to ensure an electrical resistance between the guide part 50 and the contact operating element 40 which is as low as possible.

Although the invention has been described and illustrated more specifically in detail by preferred exemplary embodiments, the invention is not restricted by the disclosed examples and other variants can be derived from said examples by a person skilled in the art, without departing from the scope of protection of the invention.

The invention claimed is:

1. A switch, comprising:

a gas-insulated tube;

a contact system disposed in said tube and having a fixed contact and a moving contact;

a moving contact operating element mechanically and electrically connected to said moving contact, routed out of said tube through an opening in said tube, and being moved along an operating direction for opening and closing said contact system;

a stationary guide part guiding said moving contact operating element;

an external drive element;

a contact-pressure spring being movable along said operating direction, being connected to said moving contact operating element and to said external drive element and being disposed in said stationary guide part;

upon said external drive element moving along said operating direction in a direction toward said fixed contact, said contact-pressure spring, said moving contact operating element and said moving contact moving in said direction toward said fixed contact, said contact system being closed and said contact-pressure spring being compressed to provide a contact-pressure force;

a spring housing being rigidly connected to said moving contact operating element and being movable relative to said stationary guide part, said contact-pressure spring being disposed in said spring housing; and at least one guide element being fixedly attached to an outside of said spring housing, said at least one guide element bearing against said stationary guide part and guiding said spring housing and said moving contact operating element along said operating direction.

2. The switch according to claim 1, wherein said at least one guide element includes two guide elements being spaced apart along said operating direction, attached to said spring housing and bearing against said guide part.

3. The switch according to claim 2, wherein said spring housing has a pot-shaped housing part and a cover part, and at least one of said two guide elements is attached to or integrally formed on said pot-shaped housing part or at least one of said two guide elements is attached to or integrally formed on said cover part.

4. The switch according to claim 1, which further comprises a further guide element guiding said moving contact operating element, said further guide element being disposed between said spring housing and said tube along said operating direction.

5. The switch according to claim 4, which further comprises a contact disk attached to or integrally formed on said moving contact operating element between said spring housing and said tube, said further guide element being attached radially to an outside of said contact disk.

6. The switch according to claim 5, wherein said contact disk and said further guide element are electrically conductive and enable a current flow in a current flow direction from said moving contact operating element, through said contact disk and said further guide element to said guide part and in a direction opposite to said current flow direction.

7. The switch according to claim 1, wherein said guide part is hollow-cylindrical or has at least one hollow-cylindrical section.

8. The switch according to claim 1, wherein said at least one guide element attached to said outside of said spring housing bears radially against an inner wall surface of said guide part.

9. The switch according to claim 1, wherein said guide part has a hollow-cylindrical section, and said at least one guide element attached to said outside of said spring housing bears radially against an inner wall surface of said hollow-cylindrical section.

10. The switch according to claim 1, wherein said at least one guide element attached to said outside of said spring housing is formed by at least one guide ring.

11. The switch according to claim 10, wherein said at least one guide ring attached to said outside of said spring housing lies in at least one guide groove formed in said spring housing.

12. The switch according to claim 1, which further comprises a bearing being part of or attached to said tube, said bearing guiding said moving contact operating element in a region of an exit point of said moving contact operating element out of said tube along said operating direction.

13. The switch according to claim 1, wherein said gas-insulated tube is a vacuum tube, and the switch is a vacuum circuit breaker.

* * * * *